US010535477B2

(12) United States Patent
Hsieh et al.

(10) Patent No.: US 10,535,477 B2
(45) Date of Patent: Jan. 14, 2020

(54) BUTTON SWITCH AND KEYSWITCH THEREOF

(71) Applicant: DARFON ELECTRONICS CORP., Taoyuan (TW)

(72) Inventors: Yu-Chun Hsieh, Taoyuan (TW); Yung-Chih Wang, Taoyuan (TW); Chen Yang, Taoyuan (TW); Chia-Hung Liu, Taoyuan (TW); Yen-Hsiao Lin, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/260,066

(22) Filed: Jan. 28, 2019

(65) Prior Publication Data

US 2019/0244770 A1 Aug. 8, 2019

(30) Foreign Application Priority Data

Feb. 8, 2018 (TW) ..... 107104444 A

(51) Int. Cl.

| | |
|---|---|
| ***H01H 13/14*** | (2006.01) |
| ***H01H 1/24*** | (2006.01) |
| ***H01H 13/705*** | (2006.01) |
| ***H01H 13/28*** | (2006.01) |
| ***H01H 3/46*** | (2006.01) |
| ***H01H 13/10*** | (2006.01) |

(52) U.S. Cl.

CPC ..... *H01H 13/14* (2013.01); *H01H 1/24* (2013.01); *H01H 3/46* (2013.01); *H01H 13/10* (2013.01); *H01H 13/28* (2013.01); *H01H 13/705* (2013.01); *H01H 2215/03* (2013.01); *H01H 2235/01* (2013.01)

(58) Field of Classification Search

CPC ..... H01H 13/14; H01H 1/24; H01H 3/46; H01H 13/10

See application file for complete search history.

(56) References Cited

U.S. PATENT DOCUMENTS

2017/0221652 A1 * 8/2017 Liao ..... G02B 6/0006

FOREIGN PATENT DOCUMENTS

| | | | | |
|---|---|---|---|---|
| CN | 106504928 A | | 3/2017 | |
| TW | 1581290 | * | 5/2017 | ..... H01H 13/85 |
| TW | I581290 B | | 5/2017 | |

* cited by examiner

*Primary Examiner* — Edwin A. Leon
*Assistant Examiner* — Iman Malakooti
(74) *Attorney, Agent, or Firm* — Winston Hsu

(57) ABSTRACT

A button switch includes a base having a pillar, a cover disposed on the base, a sleeve, an arm adjacent to the pillar and an elastic member having upward-force-applying, extending-rod, and flexible-rod portions. The sleeve jackets the pillar, passes through the cover, and has first and second ribs. The upward-force-applying portion jackets the pillar and abuts against the sleeve and the base to drive the sleeve to move away from the base. The extending-rod portion extends from the upward-force-applying portion to be connected to the flexible-rod portion located under the first rib. When the sleeve is located at a high position, the second rib biases the arm to deform. When the sleeve is located at a low position, the second rib is misaligned with the arm. The flexible-rod portion crosses the first rib to be released and then collides with the cover to make sound as the sleeve is pressed.

26 Claims, 17 Drawing Sheets

BUTTON SWITCH AND KEYSWITCH THEREOF

BACKGROUND OF THE INVENTION

1. Field of the Invention

The present invention relates to a button switch and a keyswitch thereof, and more specifically, to a button switch utilizing a flexible-rod portion extending from an elastic member to interfere with a rib of a sleeve for providing a tactile feedback and a keyswitch thereof.

2. Description of the Prior Art

A keyboard, which is the most common input device, could be found in variety of electronic apparatuses for users to input characters, symbols, numerals and so on. Furthermore, from consumer electronic products to industrial machine tools, they are all equipped with a keyboard for performing input operations.

In practical application, there are various kinds of keyswitches for providing different tactile feedbacks. For example, a gaming keyboard would indicates that it has red, brown or black keyswitches installed thereon on its packing box to remind the user of what kind of tactile feedback (e.g. high or low triggering position, long or short travel distance, required actuation force, tactile or linear feedback, clicky or non-clicky tactile feedback, etc.) the gaming keyboard could provide.

In the clicky tactile feedback design, it usually involves additionally disposing a flexible acoustic member in the button switch to interfere with a rib of a sleeve of the button switch. Accordingly, when a user presses the button switch, the rib presses the flexible acoustic member to deform, and then the flexible acoustic member crosses the rib to generate a tactile feedback or further collides with an internal member of the button switch to make sound. However, the aforesaid design usually causes a time-consuming and strenuous keyswitch manufacturing process.

SUMMARY OF THE INVENTION

The present invention provides a button switch including a base, a cover, a sleeve, an elastic member, and an arm. The base has a pillar extending along a Z-axis. The Z-axis, an X-axis and a Y-axis are perpendicular to each other. The cover is disposed on the base. The sleeve jackets the pillar to be movable upward and downward between a high position and a low position along the Z-axis. The sleeve passes through the cover and has an outer annular surface. The outer annular surface has a first rib and a second rib. The elastic member has an upward-force-applying portion, an extending-rod portion, and a flexible-rod portion. The upward-force-applying portion jackets the pillar and abuts against the sleeve and the base to drive the sleeve to move away from the base. The extending-rod portion extends from the upward-force-applying portion outwardly to be connected to the flexible-rod portion. The flexible-rod portion is located under the first rib. The arm is adjacent to the pillar. The second rib biases the arm to deform when the sleeve is located at the high position. The second rib is misaligned with the arm when the sleeve is located at the low position. When the sleeve receives an external force to move downward along the Z-axis, the flexible-rod portion needs to cross the first rib and the arm moves to be misaligned with the second rib with downward movement of the sleeve. When the sleeve moves downward along the Z-axis and deformation of the flexible-rod portion caused by pressing of the first rib is not enough to make the flexible-rod portion cross the first rib, the flexible-rod portion deforms downward with the first rib. When deformation of the flexible-rod portion caused by pressing of the first rib is enough to make the flexible-rod portion cross the first rib, the flexible-rod portion is released and then moves upward to collide with the cover to make sound. When the external force is released, the upward-force-applying portion drives the sleeve to moves upward along the Z-axis relative to the pillar for moving the arm back to be biased by the second rib.

The present invention further provides a button switch including a base, a cover, a sleeve, an elastic member, and an arm. The base has a pillar extending along a Z-axis. The Z-axis, an X-axis and a Y-axis are perpendicular to each other. The cover is disposed on the base. The sleeve jackets the pillar to be movable upward and downward between a high position and a low position along the Z-axis. The sleeve passes through the cover and has an outer annular surface. The outer annular surface has a first rib and a second rib. The elastic member has an upward-force-applying portion, an extending-rod portion, and a flexible-rod portion. The cover has a first inclined-surface structure corresponding to the flexible-rod portion. The base has a second inclined-surface structure corresponding to the flexible-rod portion. The first inclined-surface structure and the second inclined-surface structure are spaced from each other for forming a limiting rail. The upward-force-applying portion jackets the pillar and abuts against the sleeve and the base to drive the sleeve to move away from the base. The extending-rod portion extends from the upward-force-applying portion outwardly to be connected to the flexible-rod portion. The flexible-rod portion is located under the first rib and movably inserted into the limiting rail. The arm is adjacent to the pillar. The second rib biases the arm to deform when the sleeve is located at the high position. The second rib is misaligned with the arm when the sleeve is located at the low position. When the sleeve receives an external force to move downward along the Z-axis, the flexible-rod portion needs to cross the first rib and the arm moves to be misaligned with the second rib with downward movement of the sleeve. When the sleeve moves downward along the Z-axis and deformation of the flexible-rod portion caused by pressing of the first rib is not enough to make the flexible-rod portion cross the first rib, the flexible-rod portion deforms downward with the first rib and moves outwardly along the limiting rail relative to the sleeve. When deformation of the flexible-rod portion caused by pressing of the first rib is enough to make the flexible-rod portion cross the first rib, the flexible-rod portion moves inwardly along the limiting rail relative to the sleeve. When the external force is released, the upward-force-applying portion drives the sleeve to moves upward along the Z-axis relative to the pillar for moving the arm back to be biased by the second rib.

The present invention further provides a button switch including a base, a cover, a sleeve, an elastic member, an arm, a contact point, and a circuit board. The base has a pillar extending along a Z-axis. The Z-axis, an X-axis and a Y-axis are perpendicular to each other. The cover is disposed on the base. The sleeve jackets the pillar to be movable upward and downward between a high position and a low position along the Z-axis. The sleeve passes through the cover and has an outer annular surface. The outer annular surface has a first rib and a second rib. The elastic member jackets the pillar and abuts against the sleeve and the base to drive the sleeve to move away from the base. The arm is adjacent to the pillar. The second rib biases the arm to deform when the sleeve is located at the high position. The second rib is misaligned with the arm when the sleeve is located at the low position. The contact point is opposite to the arm. The arm and the contact point are disposed substantially along a plane defined by the X-axis and the Y-axis. The circuit board is electrically connected to the arm and the contact point respectively. When the sleeve is located at the high position, the second rib biases the arm to deform for making the arm separate from the contact point. When the sleeve receives an external force to move downward to the low position along the Z-axis, the arm moves to be misaligned with the second rib with downward movement of the sleeve and deformation of the arm is reduced to make the arm abut against the contact point. When the external force is released, the elastic member drives the sleeve to moves upward along the Z-axis relative to the pillar for moving the arm back to be biased by the second rib.

The present invention further provides a keyswitch including a cap, a base, a cover, a sleeve, an elastic member, and an arm. The base has a pillar extending along a Z-axis. The Z-axis, an X-axis and a Y-axis are perpendicular to each other. The cover is disposed on the base. The sleeve jackets the pillar and passes through the cover to be connected to the cap for making the cap movable upward and downward between a high position and a low position along the Z-axis. The sleeve has an outer annular surface. The outer annular surface has a first rib and a second rib. The elastic member has an upward-force-applying portion, an extending-rod portion, and a flexible-rod portion. The upward-force-applying portion jackets the pillar and abuts against the sleeve and the base to drive the sleeve to move away from the base. The extending-rod portion extends from the upward-force-applying portion outwardly to be connected to the flexible-rod portion. The flexible-rod portion is located under the first rib. The arm is adjacent to the pillar. The second rib biases the arm to deform when the cap is located at the high position. The second rib is misaligned with the arm when the cap is located at the low position. When the cap receives an external force to drive the sleeve to move downward along the Z-axis, the flexible-rod portion needs to cross the first rib and the arm moves to be misaligned with the second rib with downward movement of the sleeve. When the sleeve moves downward along the Z-axis and deformation of the flexible-rod portion caused by pressing of the first rib is not enough to make the flexible-rod portion cross the first rib, the flexible-rod portion deforms downward with the first rib. When deformation of the flexible-rod portion caused by pressing of the first rib is enough to make the flexible-rod portion cross the first rib, the flexible-rod portion is released and then moves upward to collide with the cover to make sound. When the external force is released, the upward-force-applying portion drives the sleeve to moves upward along the Z-axis relative to the pillar for moving the arm back to be biased by the second rib.

The present invention further provides a keyswitch including a cap, a base, a cover, a sleeve, an elastic member, and an arm. The base has a pillar extending along a Z-axis. The Z-axis, an X-axis and a Y-axis are perpendicular to each other. The cover is disposed on the base. The sleeve jackets the pillar and passes through the cover to be connected to the cap for making the cap movable upward and downward between a high position and a low position along the Z-axis. The sleeve has an outer annular surface. The outer annular surface has a first rib and a second rib. The elastic member has an upward-force-applying portion, an extending-rod portion, and a flexible-rod portion. The cover has a first inclined-surface structure corresponding to the flexible-rod portion. The base has a second inclined-surface structure corresponding to the flexible-rod portion. The first inclined-surface structure and the second inclined-surface structure are spaced from each other for forming a limiting rail. The upward-force-applying portion jackets the pillar and abuts against the sleeve and the base to drive the sleeve to move away from the base. The extending-rod portion extends from the upward-force-applying portion outwardly to be connected to the flexible-rod portion. The flexible-rod portion is located under the first rib and movably inserted into the limiting rail. The arm is adjacent to the pillar. The second rib biases the arm to deform when the sleeve is located at the high position. The second rib is misaligned with the arm when the sleeve is located at the low position. When the cap receives an external force to drive the cap to move downward along the Z-axis, the flexible-rod portion needs to cross the first rib and the arm moves to be misaligned with the second rib with downward movement of the sleeve. When the sleeve moves downward along the Z-axis and deformation of the flexible-rod portion caused by pressing of the first rib is not enough to make the flexible-rod portion cross the first rib, the flexible-rod portion deforms downward with the first rib and moves outwardly along the limiting rail relative to the sleeve. When deformation of the flexible-rod portion caused by pressing of the first rib is enough to make the flexible-rod portion cross the first rib, the flexible-rod portion moves inwardly along the limiting rail relative to the sleeve. When the external force is released, the upward-force-applying portion drives the sleeve to moves upward along the Z-axis relative to the pillar for moving the arm back to be biased by the second rib.

The present invention further provides a keyswitch including a cap, a base, a cover, a sleeve, an elastic member, an arm, a contact point, and a circuit board. The base has a pillar extending along a Z-axis. The Z-axis, an X-axis and a Y-axis are perpendicular to each other. The cover is disposed on the base. The sleeve jackets the pillar and passes through the cover to be connected to the cap for making the cap movable upward and downward between a high position and a low position along the Z-axis. The sleeve has an outer annular surface. The outer annular surface has a first rib and a second rib. The elastic member jackets the pillar and abuts against the sleeve and the base to drive the sleeve to move away from the base. The arm is adjacent to the pillar. The second rib biases the arm to deform when the sleeve is located at the high position. The second rib is misaligned with the arm when the sleeve is located at the low position. The contact point is opposite to the arm. The arm and the contact point are disposed substantially along a plane defined by the X-axis and the Y-axis. The circuit board is electrically connected to the arm and the contact point respectively. When the cap is located at the high position, the second rib biases the arm to deform for making the arm separate from the contact point. When the cap receives an external force to move downward to the low position along the Z-axis, the arm moves to be misaligned with the second rib with downward movement of the sleeve and deformation of the arm is reduced to make the arm abut against the contact point. When the external force is released, the elastic member drives the sleeve to moves upward along the Z-axis relative to the pillar for moving the arm back to be biased by the second rib.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
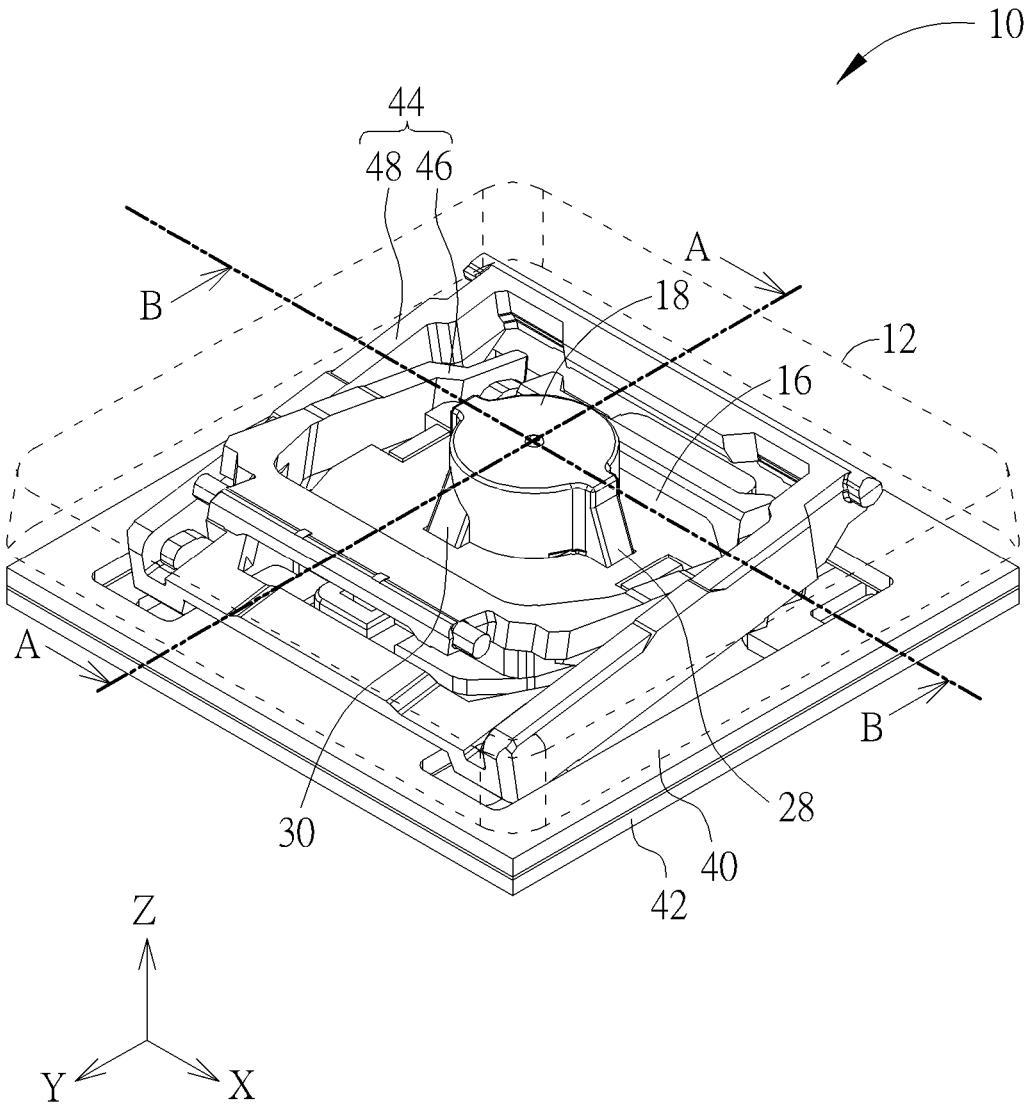
FIG. 1 is a diagram of a keyswitch according to an embodiment of the present invention.
Figure 2:
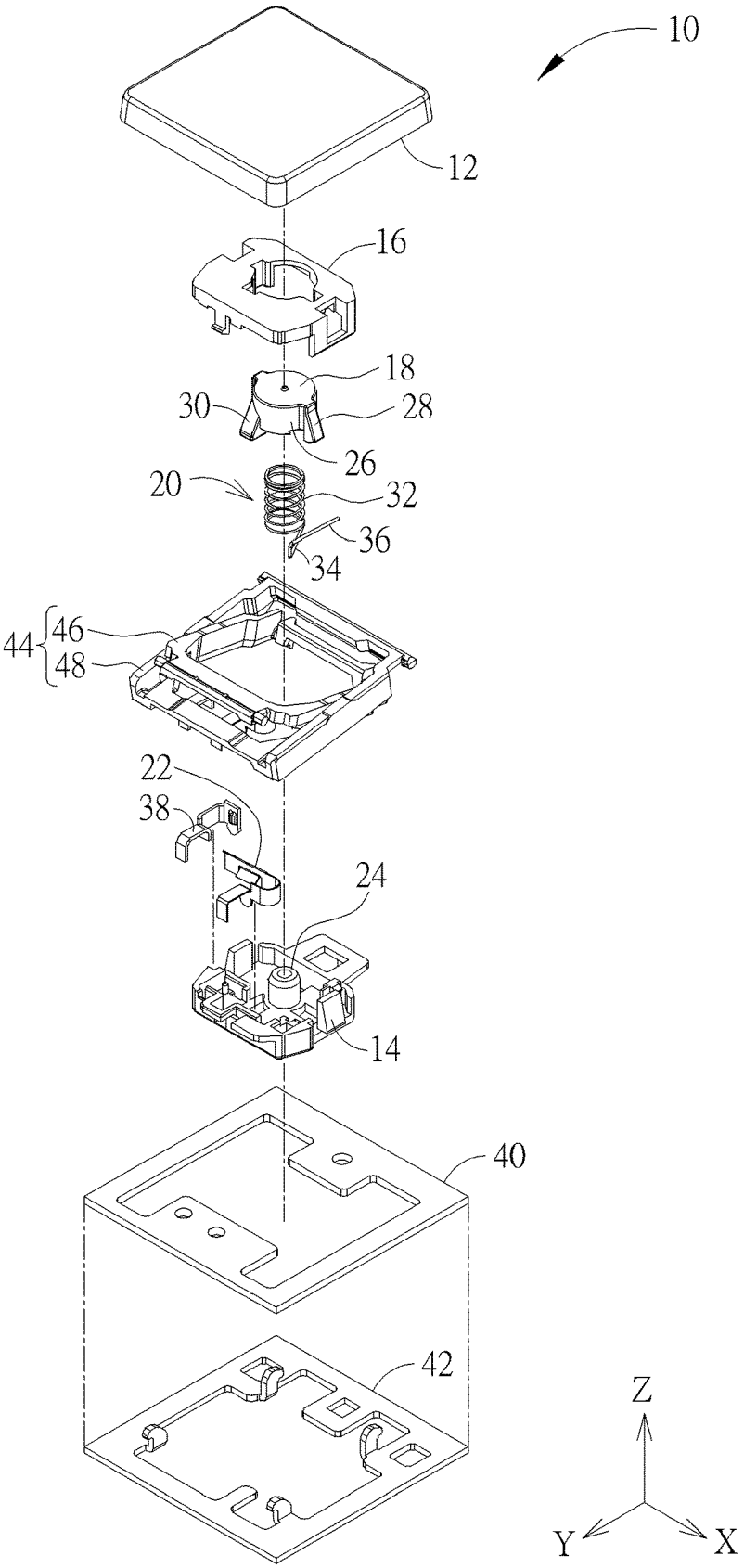
FIG. 2 is an exploded diagram of the keyswitch in FIG. 1.
Figure 3:
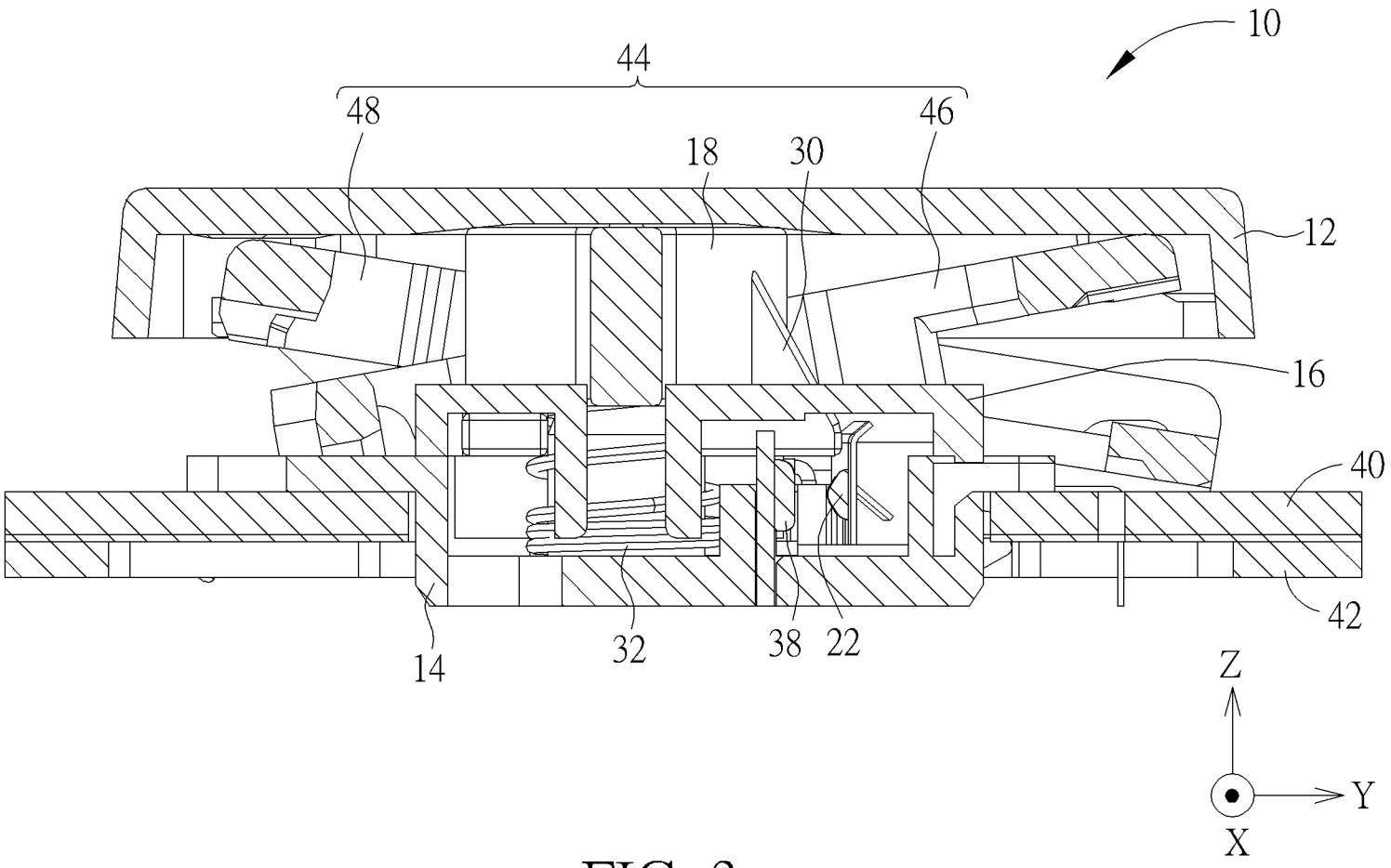
FIG. 3 is a cross-sectional diagram of the keyswitch in FIG. 1 along a cross-sectional line A-A.
Figure 4:
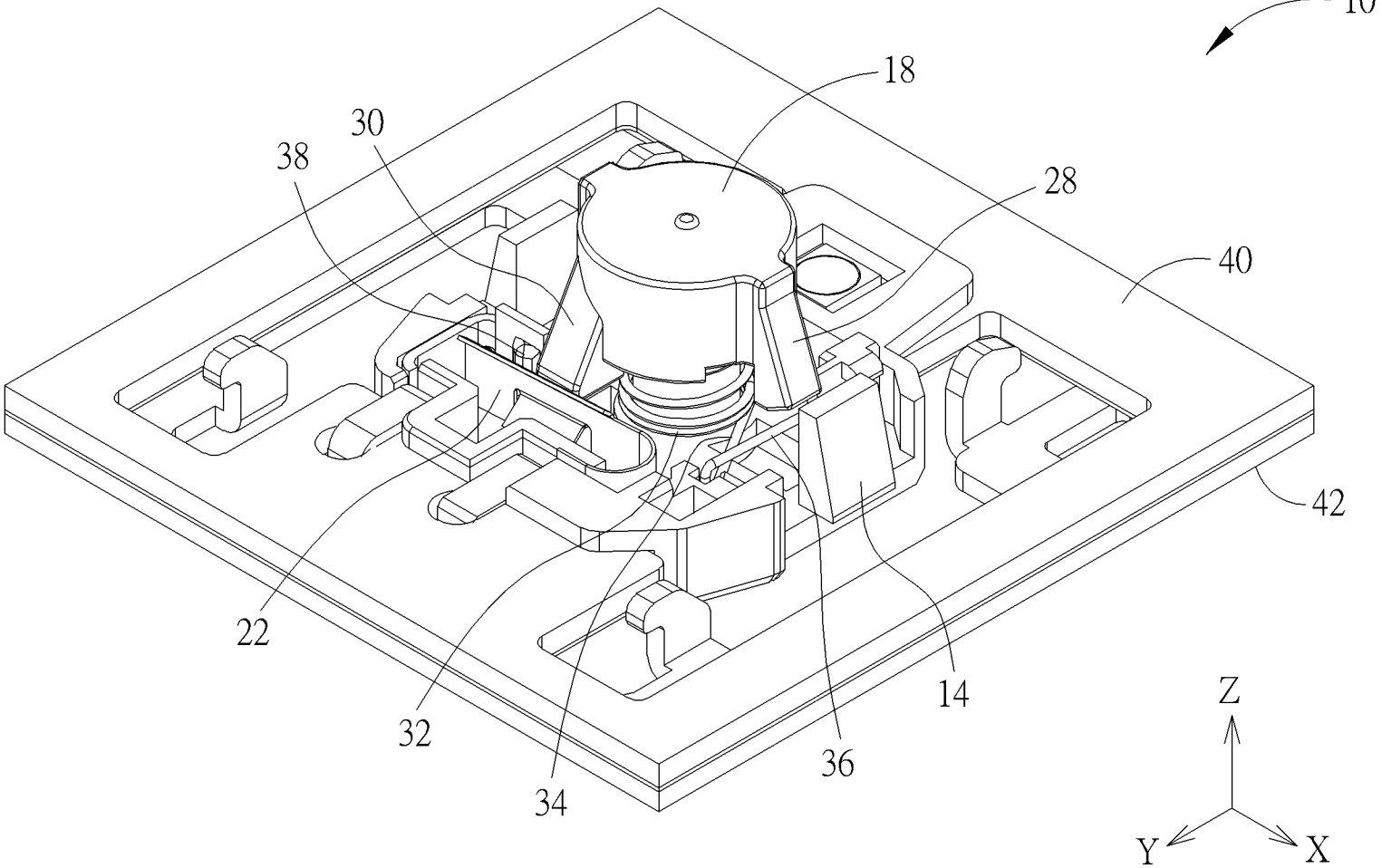
FIG. 4 is an internal diagram of the keyswitch in FIG. 1.
Figure 5:
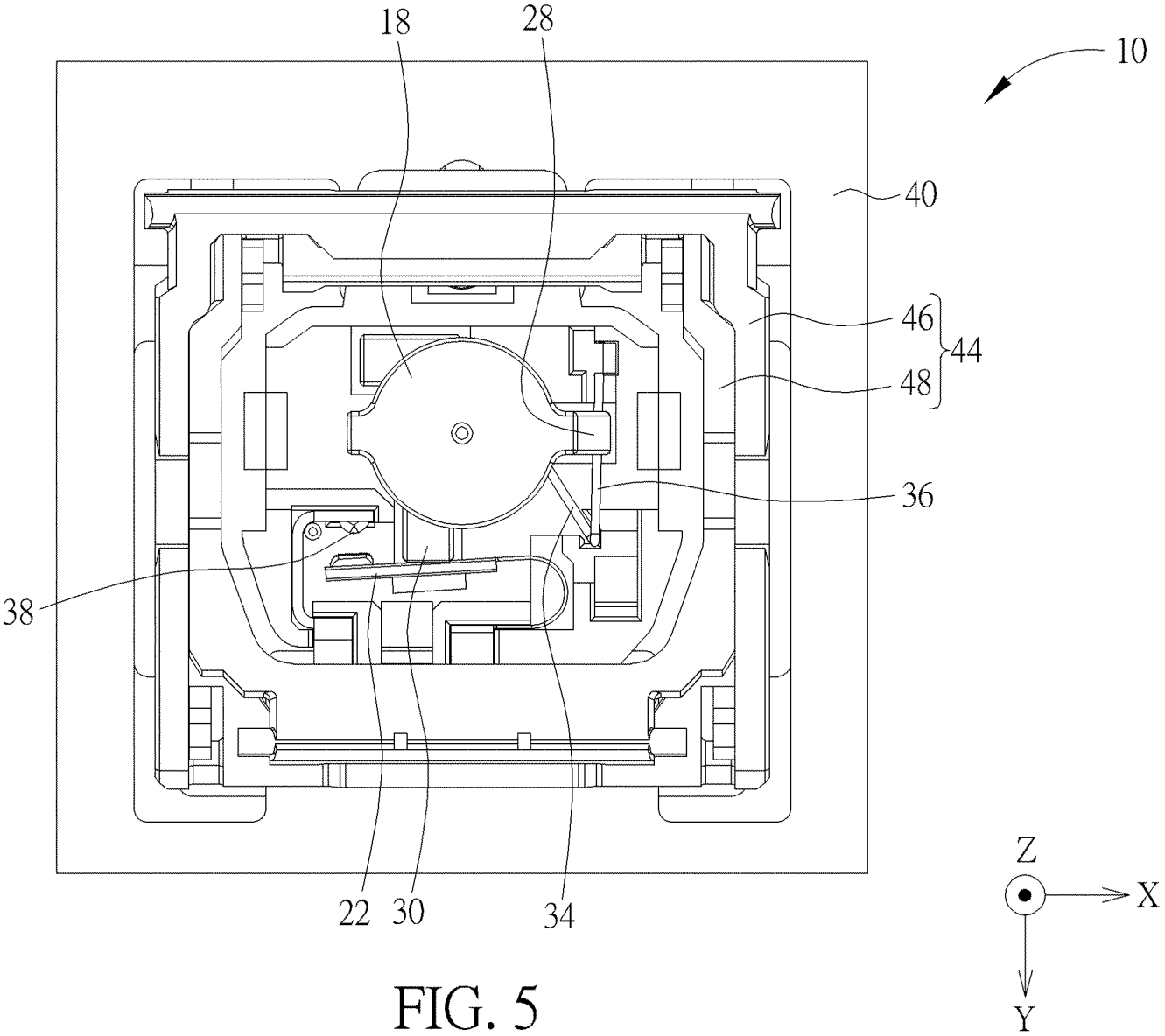
FIG. 5 is a top view of the keyswitch in FIG. 1 omitting a cap and a cover.
Figure 6:
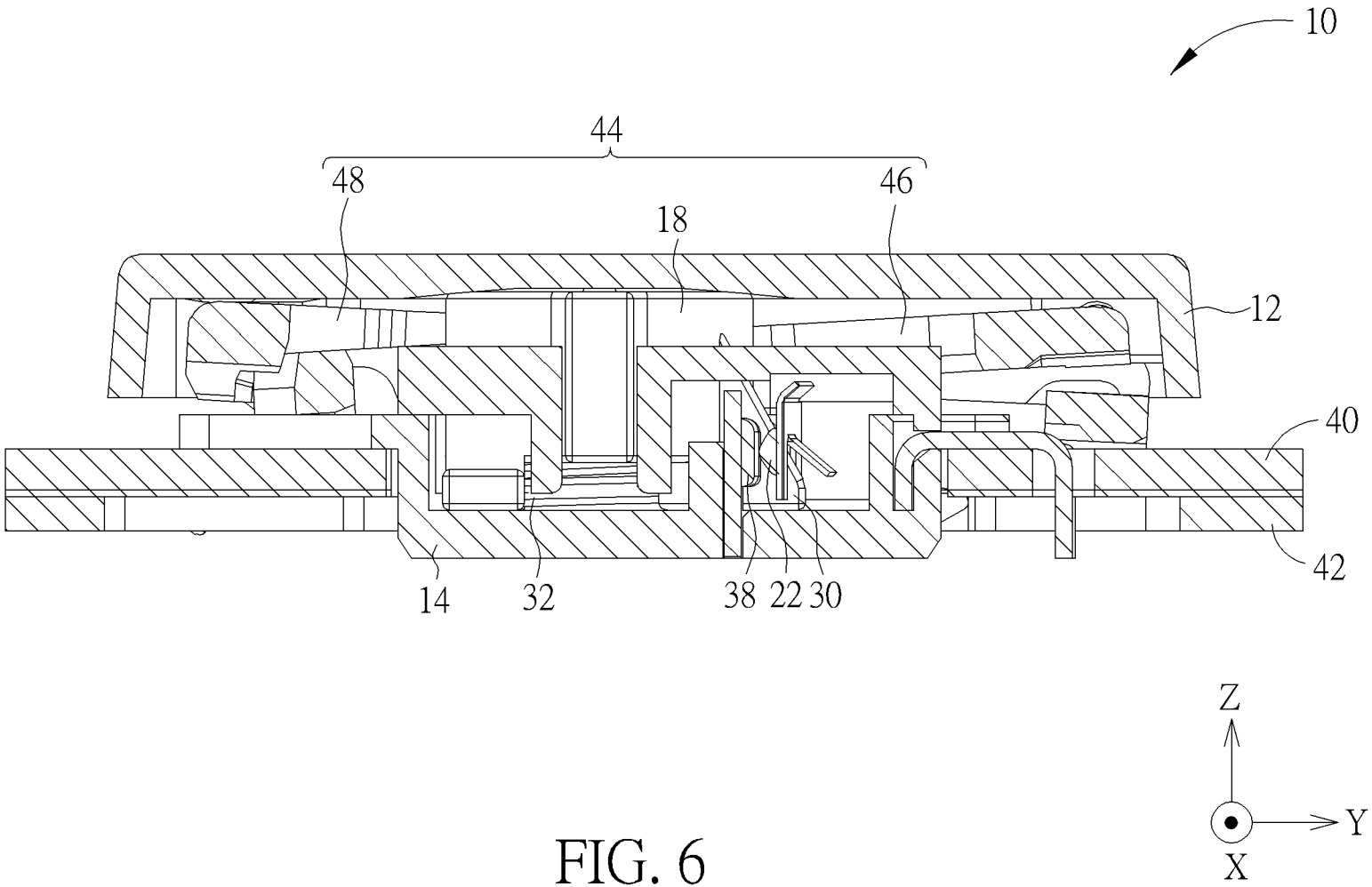
FIG. 6 is a cross-sectional diagram of the cap in FIG. 3 being pressed to a low position.

Please refer to FIG. 1, FIG. 2, FIG. 3, FIG. 4, FIG. 5, and FIG. 6. FIG. 1 is a diagram of a keyswitch 10 according to an embodiment of the present invention. FIG. 2 is an exploded diagram of the keyswitch 10 in FIG. 1. FIG. 3 is a cross-sectional diagram of the keyswitch 10 in FIG. 1 along a cross-sectional line A-A. FIG. 4 is an internal diagram of the keyswitch 10 in FIG. 1. FIG. 5 is a top view of the keyswitch 10 in FIG. 1 omitting a cap 12 and a cover 16. FIG. 6 is a cross-sectional diagram of the cap 12 in FIG. 3 being pressed to a low position. As shown in FIGS. 1-6, the keyswitch 10 includes the cap 12, a base 14, the cover 16, a sleeve 18, an elastic member 20, and an arm 22. The base 14 has a pillar 24. The pillar 24 extends along a Z-axis as shown in FIG. 2. The Z-axis, an X-axis and a Y-axis are perpendicular to each other. The arm 22 is adjacent to the pillar 24. The cover 16 is disposed on the base 14. The sleeve 18 jackets the pillar 24. The sleeve 18 passes through the cover 16 to be connected to the cap 12 for making the cap 12 movable upward and downward between a high position and the low position along the Z-axis. The sleeve 18 has an outer annular surface 26. The outer annular surface 26 has a first rib 28 and a second rib 30. The elastic member 20 has an upward-force-applying portion 32, an extending-rod portion 34, and a flexible-rod portion 36. The upward-force-applying portion 32 (preferably a spring, but not limited thereto) jackets the pillar 24 and abuts against the sleeve 18 and the base 14 to drive the sleeve 18 to move away from the base 14. The extending-rod portion 34 extends from the upward-force-applying portion 32 outwardly to be connected to the flexible-rod portion 36. The flexible-rod portion 36 is located under the first rib 28 (as shown in FIG. 4).

As shown in FIG. 2, the keyswitch 10 could further include a contact point 38 and a circuit board 40. The arm 22 is opposite to the contact point 38, and the circuit board 40 is coupled to the arm 22 and the contact point 38. In this embodiment, the arm 22 and the contact point 38 could be disposed substantially along a plane defined by the X-axis and the Y-axis (as shown in FIG. 4 and FIG. 5, but not limited thereto), so as to further reduce the overall structural height of the keyswitch 10. To be more specific, when the cap 12 is located at the high position as shown in FIG. 3, the second rib 30 biases the arm 22 to deform along the plane defined by the X-axis and the Y-axis to make the arm 22 separate from the contact point 38. When the cap 12 is pressed by an external force to move from a position as shown in FIG. 3 downward to the low position as shown in FIG. 6, the arm 22 moves to be misaligned with the second rib 30. During this process, deformation of the arm 22 is reduced to make the arm 22 abut against the contact point 38 for transmitting a corresponding input signal to the circuit board 40, so that the keyswitch 10 can perform a corresponding input function. On the other hand, when the external force is released, the upward-force-applying portion 32 drives the sleeve 18 to move upward along the Z-axis to move the cap 12 back to the high position, so as to make the arm 22 be biased by the second rib 30 and then separate from the contact point 38 (as shown in FIG. 3). As such, the cap 12 can move back to its original position for a user to press.

In practical application, as shown in FIG. 2, the keyswitch 10 could further include a bottom board 42. The bottom board 42 is disposed under the circuit board 40 for providing a support function. The base 14 passes through the circuit board 40 to be disposed on the bottom board 42 for further reducing the overall structural thickness of the base 14, the circuit board 40, and the bottom board 42, so as to be advantageous to the thinning design of the keyswitch 10. Furthermore, the keyswitch 10 could further adopt a lifting mechanical design to be applied to a portable electronic device having a foldable mechanism composed of an upper cover and a low casing, such as a notebook keyboard or a foldable keyboard. As shown in FIG. 2, the keyswitch 10 could further include a lifting mechanism 44 connected to the bottom board 42 and the cap 12. In this embodiment, the lifting mechanism 44 could preferably adopt a scissor support mechanical design, but not limited thereto, meaning that the present invention could also adopt other lifting mechanical design (e.g. a butterfly-wing lifting mechanical design). The lifting mechanism 44 includes a first support member 46 and a second support member 48. The first support member 46 and the second support member 48 are movably connected to the bottom board 42 and the cap 12 and pivotably intersect with each other, so that the cap 12 can move more steadily between the high position and the low position relative to the bottom board 12.

Figure 7:
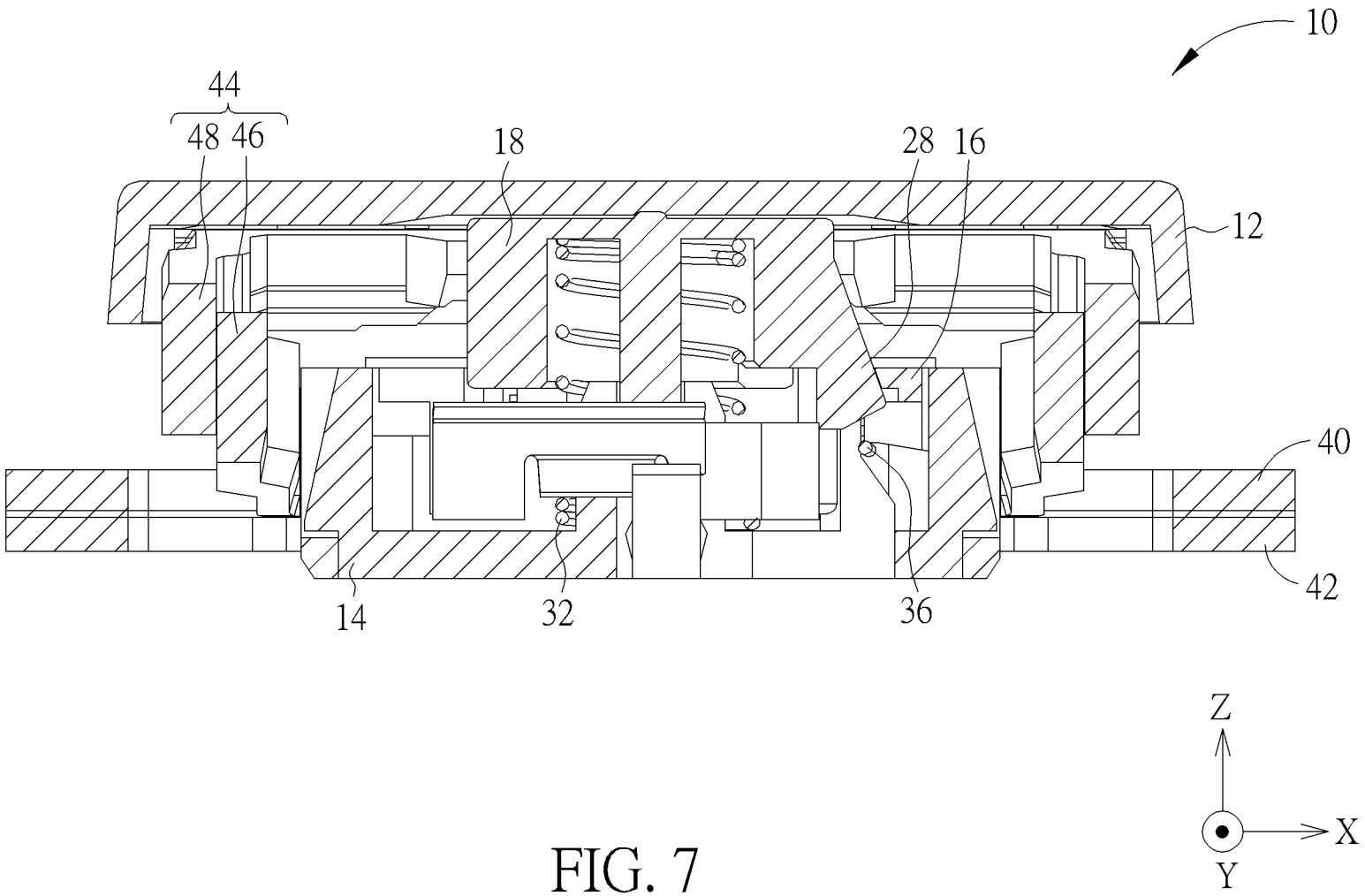
FIG. 7 is a cross-sectional diagram of the keyswitch in FIG. 1 along a cross-sectional line B-B.
Figure 8:
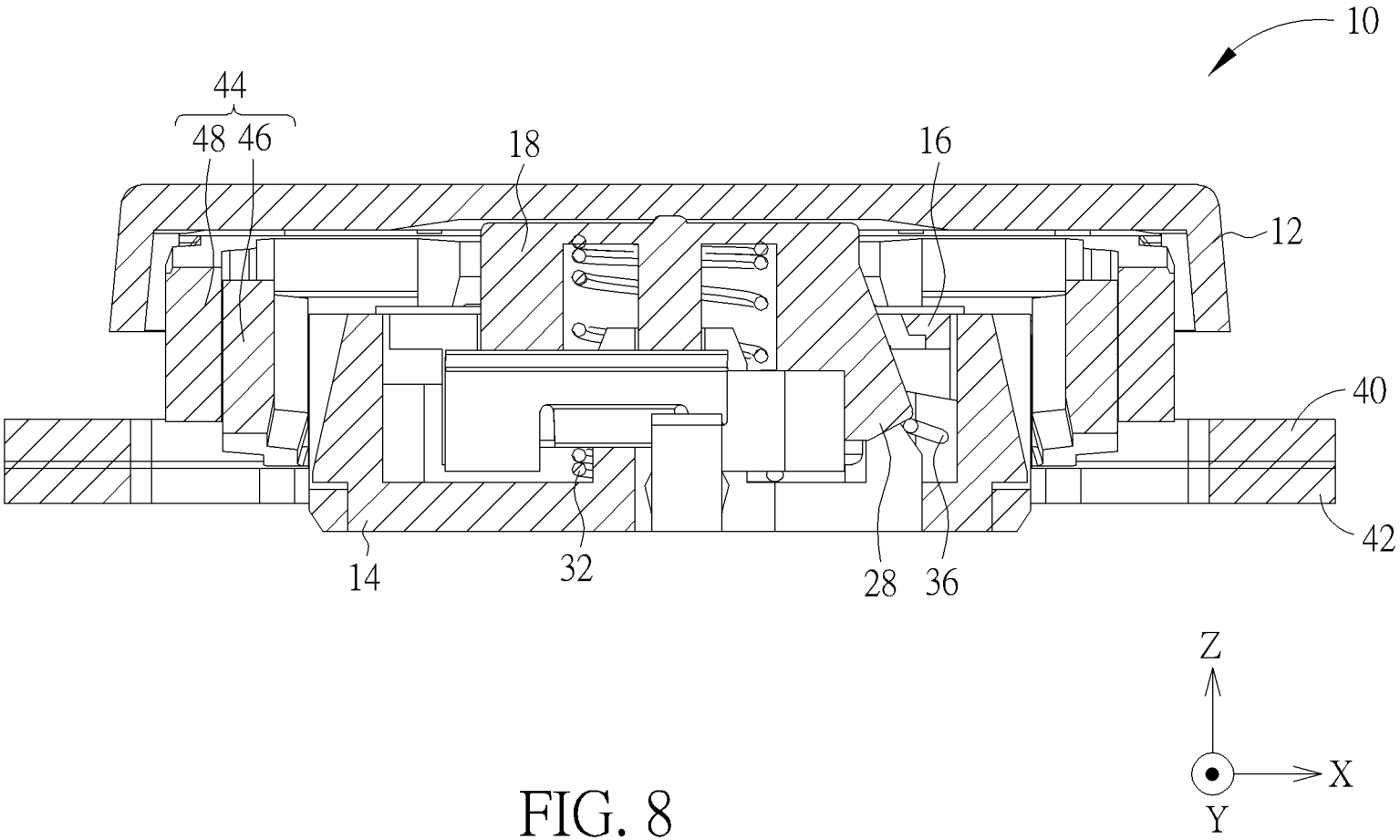
FIG. 8 is a cross-sectional diagram of a first rib in FIG. 7 pressing a flexible-rod portion to deform with downward movement of a sleeve.
Figure 9:
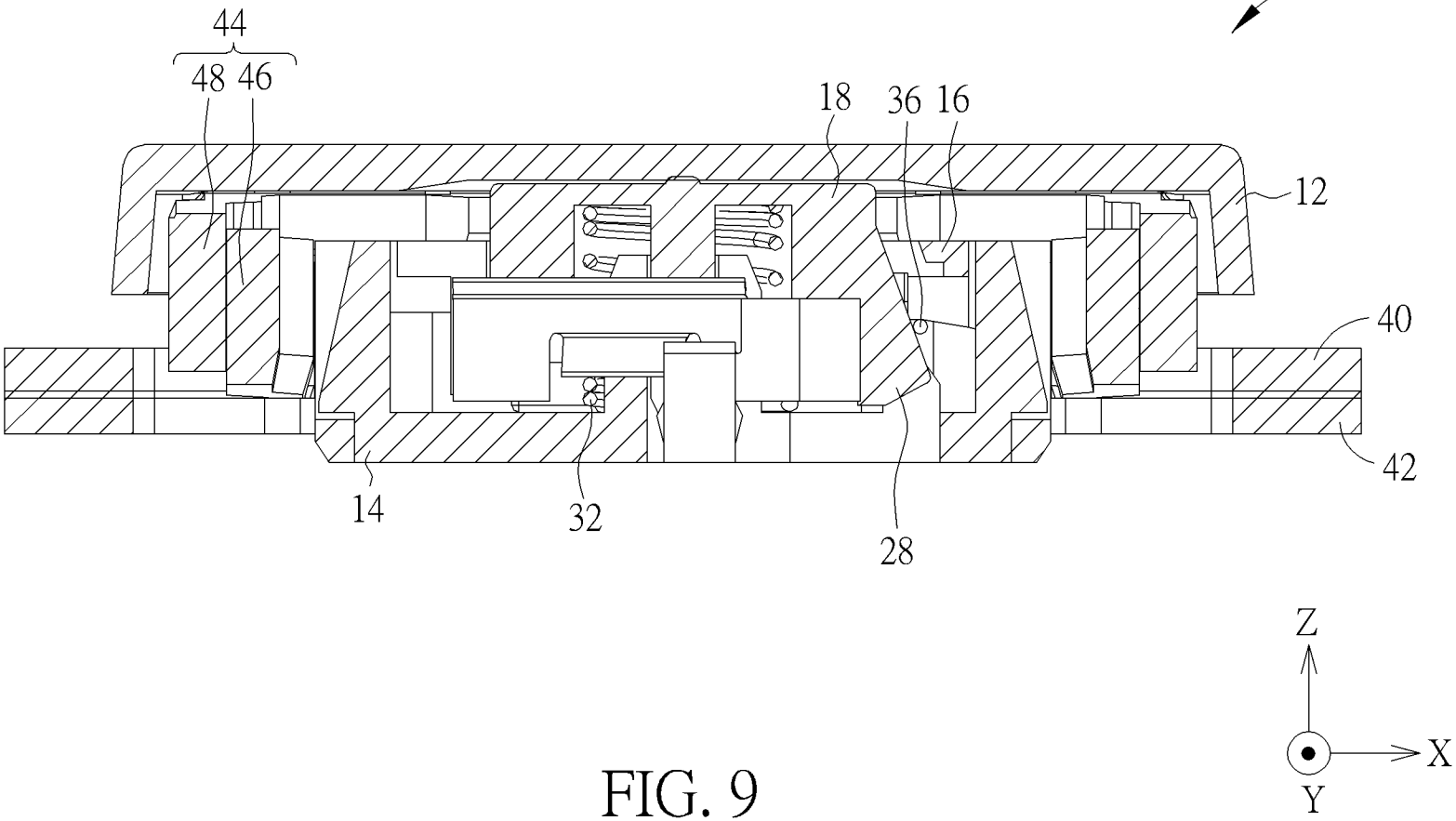
FIG. 9 is a cross-sectional diagram of the flexible-rod portion in FIG. 8 crossing the first rib to be released.

After the aforesaid operations are completed and the cap 12 is assembled with the base 14 via the sleeve 18, the keyswitch 10 can provide a clicky tactile feedback with a click sound when the user presses the cap 12. To be more specific, please refer to FIG. 3, FIG. 6, FIG. 7, FIG. 8, and FIG. 9. FIG. 7 is a cross-sectional diagram of the keyswitch 10 in FIG. 1 along a cross-sectional line B-B. FIG. 8 is a cross-sectional diagram of the first rib 28 in FIG. 7 pressing the flexible-rod portion 36 to deform with downward movement of the sleeve 18. FIG. 9 is a cross-sectional diagram of the flexible-rod portion 36 in FIG. 8 crossing the first rib 28 to be released. When the cap 12 is located at the high position as shown in FIG. 3 (at this time, as shown in FIG. 7, the first rib 28 is located above the flexible-rod portion 36) and the cap 12 receives an external force to move the sleeve 18 downward along the Z-axis, the flexible-rod portion 36 needs to cross the first rib 28 with downward movement of the sleeve 18. During the aforesaid process, the flexible-rod portion 36 deforms downward with the first rod 28 (as shown in FIG. 8) when the cap 12 moves downward along the Z-axis and deformation of the flexible-rod portion 36 caused by pressing of the first rib 28 is not enough to make the flexible-rod portion 36 cross the first rib 28. Subsequently, when an upward recovering force generated by deformation of the flexible-rod portion 36 increases to make the flexible-rod portion 36 cross the first rib 28, the deformed flexible-rod portion 36 is no longer pressed by the first rib 28. At this time, the flexible-rod portion 36 is released to move upward to a position as shown in FIG. 9 and then collides with the cover 16 for making a click sound. In such a manner, the keyswitch 10 can provide a clicky tactile feedback when the first rib 28 presses the flexible-rod portion 36 to deform and then the flexible-rod portion 36 is released, and the keyswitch 10 can further provide a tactile feedback with a click sound when the flexible-rod portion 36 collides with the cover 16. Finally, when the cap 12 is pressed to the low position as shown in FIG. 6, the arm 22 moves from a position where the arm 22 is biased by the second rib 30 as shown in FIG. 3 to a position where the arm 22 is misaligned with the second rib 30 as shown in FIG. 6. During the aforesaid process, deformation of the arm 22 is reduced to make the arm 22 trigger the contact point 38 for performing a corresponding input function.

In summary, since the present invention adopts the integral forming design that the flexible-rod portion is connected to the upward-force-applying portion via the extending-rod portion to cooperatively form the elastic member, the present invention can efficiently solve the prior art problem that additionally disposing the flexible acoustic member in the keyswitch causes a time-consuming and strenuous keyswitch manufacturing process.

Figure 10:
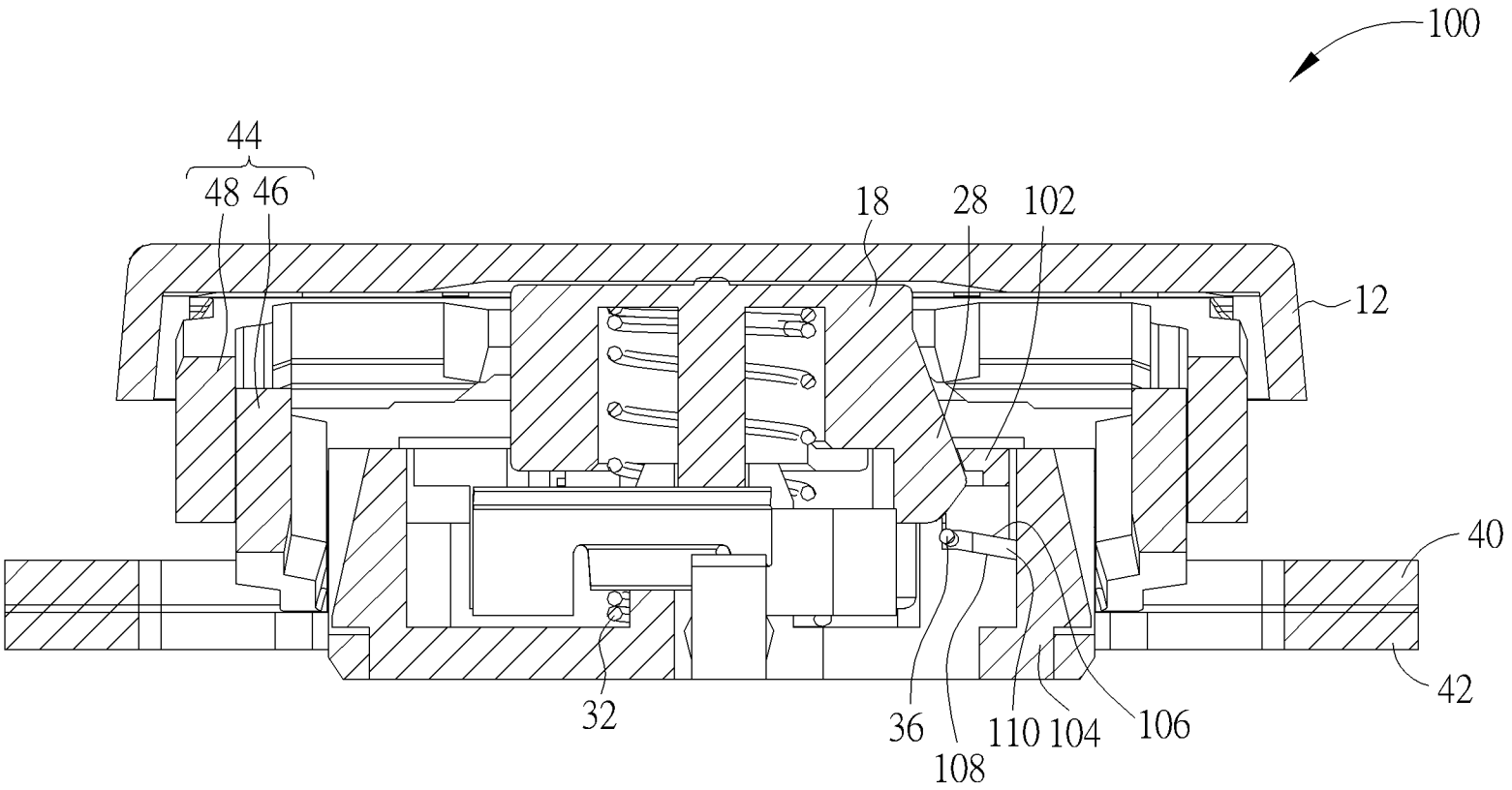
FIG. 10 is a cross-sectional diagram of a keyswitch according to another embodiment of the present invention.
Figure 11:
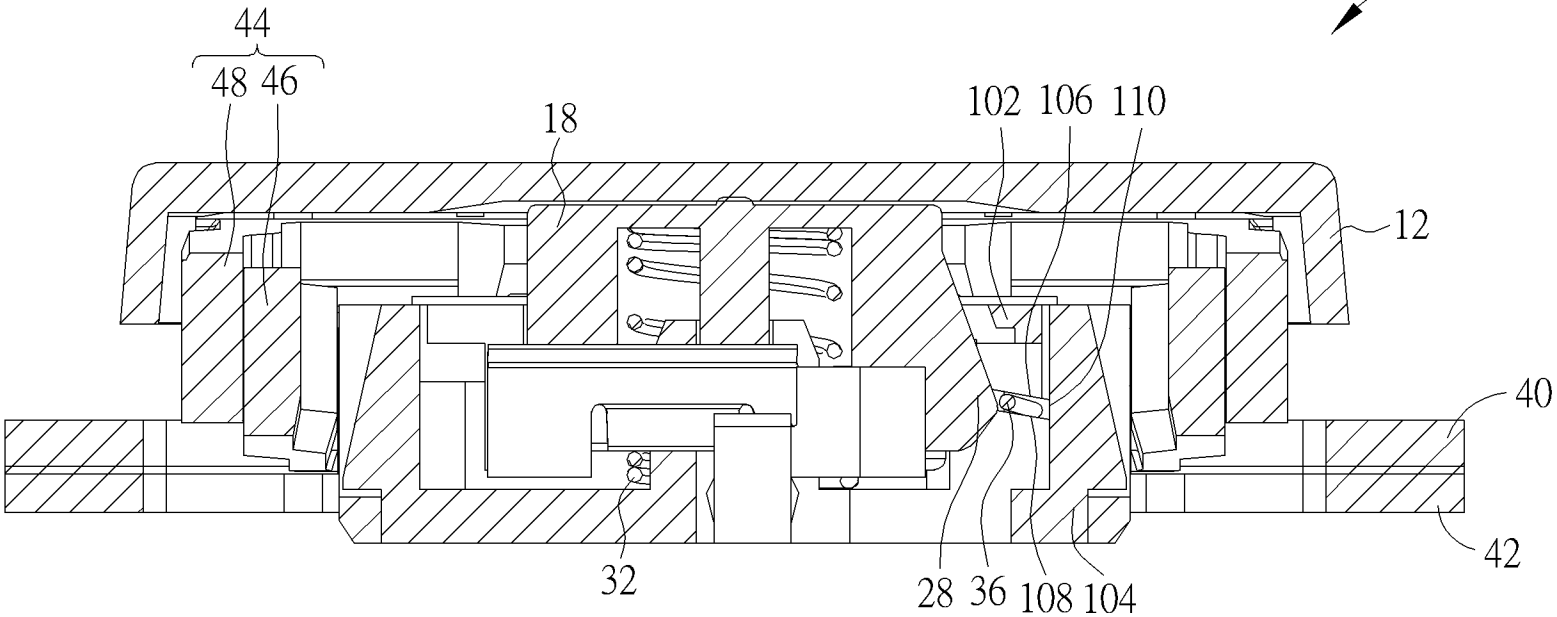
FIG. 11 is a cross-sectional diagram of the first rib pressing the flexible-rod portion to deform with downward movement of the sleeve.
Figure 12:
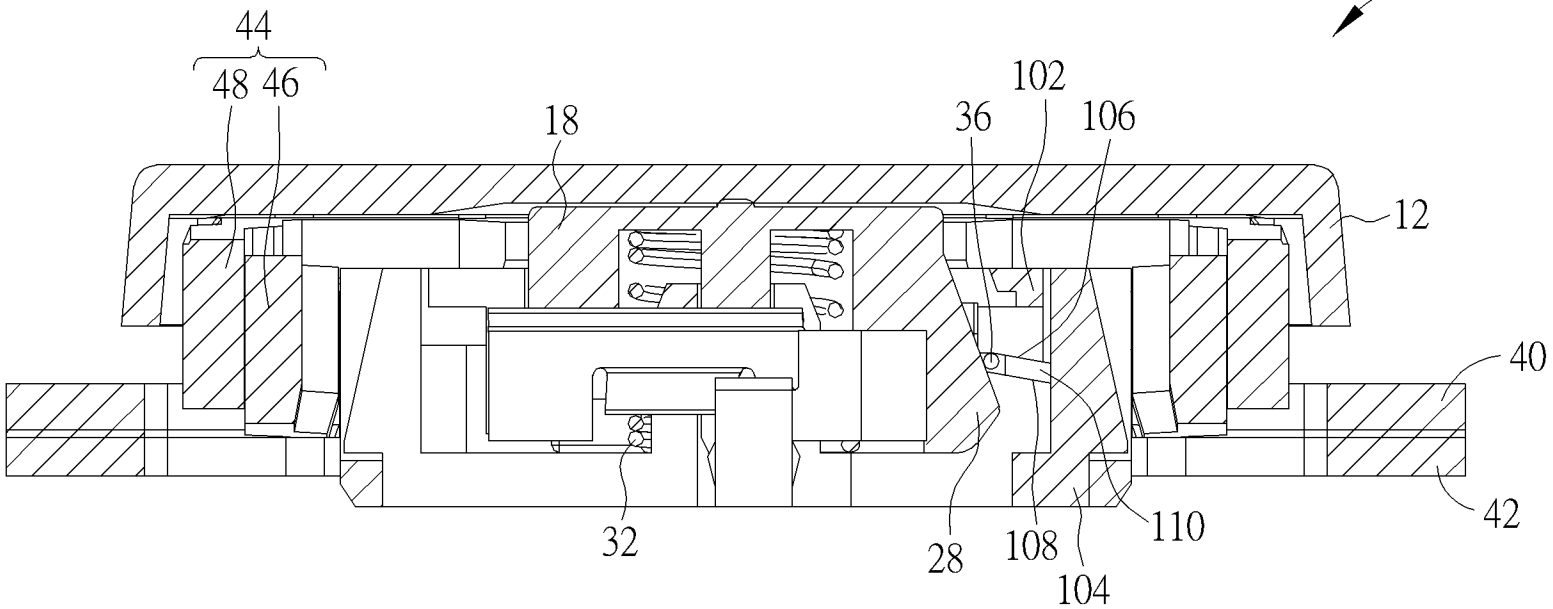
FIG. 12 is a cross-sectional diagram of the flexible-rod portion in FIG. 11 crossing the first rib to be released.

It should be mentioned that the present invention is not limited to the aforesaid embodiment, meaning that the present invention could adopt the design that the keyswitch only provides a clicky tactile feedback. Please refer to FIG. 10, FIG. 11, and FIG. 12. FIG. 10 is a cross-sectional diagram of a keyswitch 100 according to another embodiment of the present invention. FIG. 11 is a cross-sectional diagram of the first rib 28 pressing the flexible-rod portion 36 to deform with downward movement of the sleeve 18. FIG. 12 is a cross-sectional diagram of the flexible-rod portion 36 in FIG. 11 crossing the first rib 28 to be released. Components both mentioned in this embodiment and the aforesaid embodiment represent components with similar structures or functions, and the related description is omitted herein. As shown in FIG. 10, FIG. 11, and FIG. 12, the keyswitch 100 includes a cover 102, a base 104, the cap 12, the sleeve 18, the elastic member 20 (only a portion of the elastic member 20 corresponding to the flexible-rod portion 36 is shown), the circuit board 40, the bottom board 42, and the lifting mechanism 44 (the arm 22 and the contact point 38 not shown in FIGS. 10-12). The cover 102 has a first inclined-surface structure 106 corresponding to the flexible-rod portion 36, and the base 104 has a second inclined-surface structure 108 corresponding to the flexible-rod portion 36. The first inclined-surface structure 106 and the second inclined-surface structure 108 are spaced from each other for cooperatively forming a limiting rail 110. The flexible-rod portion 36 is movably inserted into the limiting rail 110.

Via the aforesaid designs, when the cap 12 is located at the high position as shown in FIG. 10 (at this time, the first rib 28 is located above the flexible-rod portion 36) and the cap 12 receives an external force to move the sleeve 18 downward along the Z-axis, the flexible-rod portion 36 needs to cross the first rib 28 with downward movement of the sleeve 18. During the aforesaid process, the flexible-rod portion 36 deforms downward with the first rod 28 and moves outwardly along the limiting rail 110 relative to the sleeve 18 (as shown in FIG. 11) when the cap 12 moves downward along the Z-axis and deformation of the flexible-rod portion 36 caused by pressing of the first rib 28 is not enough to make the flexible-rod portion 36 cross the first rib 28. Subsequently, when an upward recovering force generated by deformation of the flexible-rod portion 36 increases to make the flexible-rod portion 36 cross the first rib 28, the deformed flexible-rod portion 36 is no longer pressed by the first rib 28. As such, the flexible-rod portion 36 can move inwardly along the limiting rail 110 relative to the sleeve 18. In such a manner, the keyswitch 100 can provide a clicky tactile feedback when the flexible-rod portion 36 moves along the limiting rail 110 to cross the first rib 28.

Figure 13:
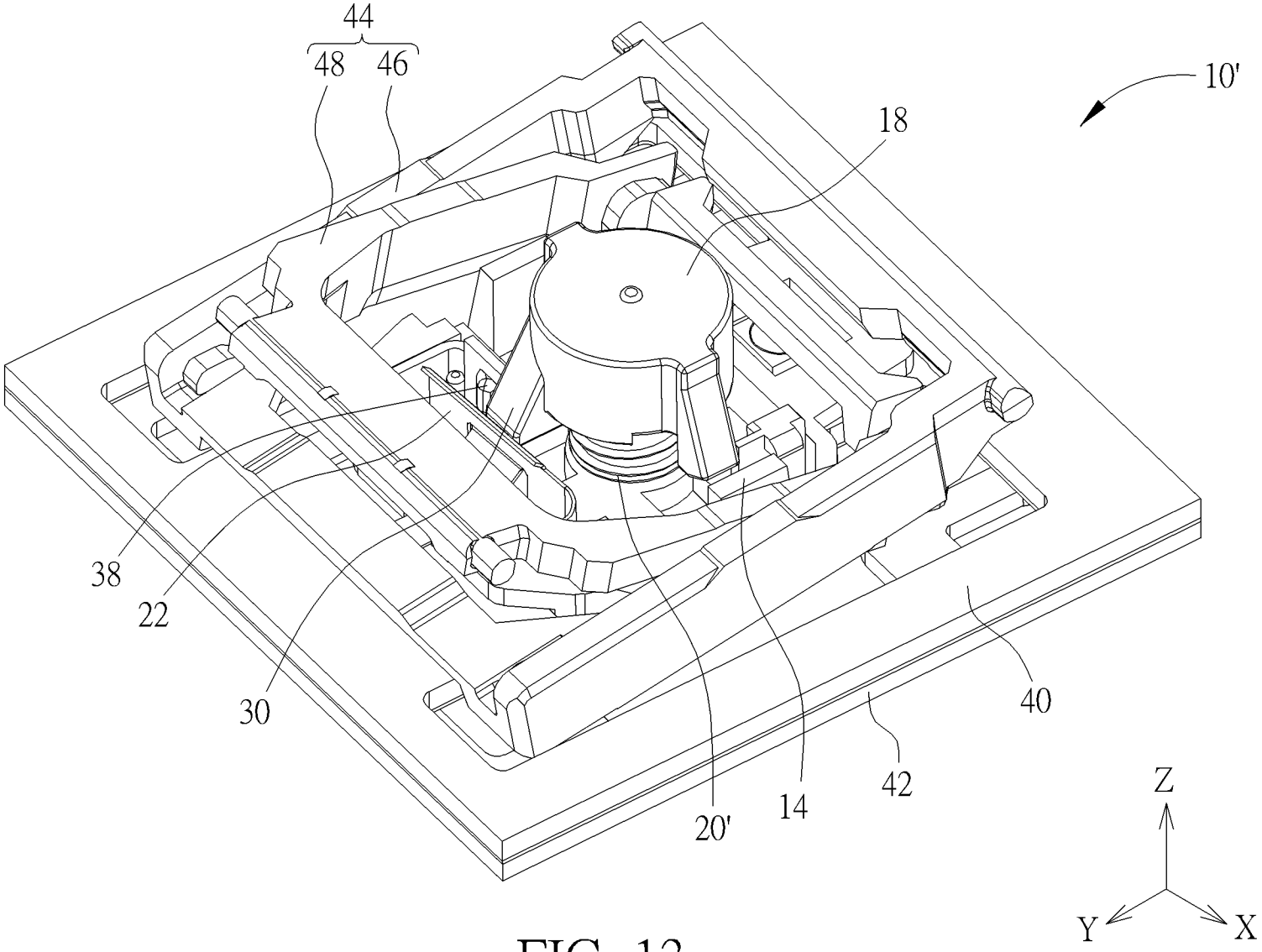
FIG. 13 is a diagram of a keyswitch according to another embodiment of the present invention.

Furthermore, the present invention could adopt the design that the keyswitch can provide a non-clicky tactile feedback without a click sound when the user presses the cap 12. Please refer to FIG. 13, which is a diagram of a keyswitch 10' according to another embodiment of the present invention. For clearly showing the internal mechanical design of the keyswitch 10', the cap 12 and the cover 16 are omitted in the FIG. 13. Components both mentioned in this embodiment and the aforesaid embodiments represent components with similar structures or functions, and the related description is omitted herein. As shown in FIG. 13, the keyswitch 10' includes the cap 12, the base 14, the cover 16, the sleeve 18, an elastic member 20', the arm 22, the contact point 38, the circuit board 40, the bottom board 42, and the lifting mechanism 44. In this embodiment, the elastic member 20' could preferably be a spring, but not limited thereto. The elastic member 20' abuts against the sleeve 18 and the base 14 respectively for providing elastic force to drive the sleeve 18 to move away from the base 14. As mentioned in the aforesaid embodiments, the arm 22 and the contact point 38 could preferably be disposed along the plane defined by the X-axis and the Y-axis, so as to further reduce the overall height of the keyswitch 10'. Via the aforesaid designs, as shown in FIG. 13, since the elastic member 20' does not have any flexible-rod portion to interfere with the sleeve 18, the keyswitch 10' can provide a non-clicky tactile feedback without a click sound when the user presses the cap 12.

Figure 14:
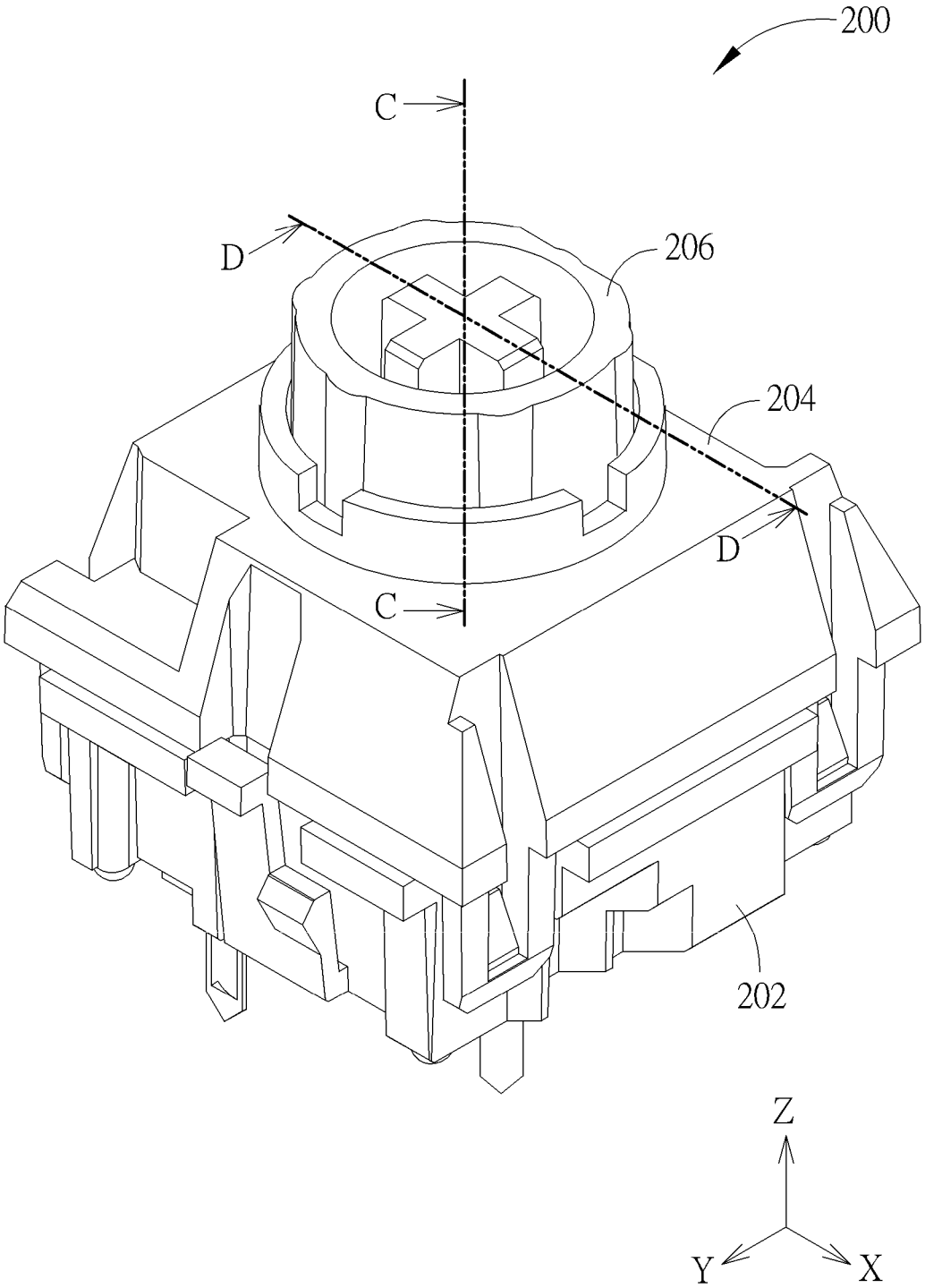
FIG. 14 is a diagram of a button switch according to another embodiment of the present invention.
Figure 15:
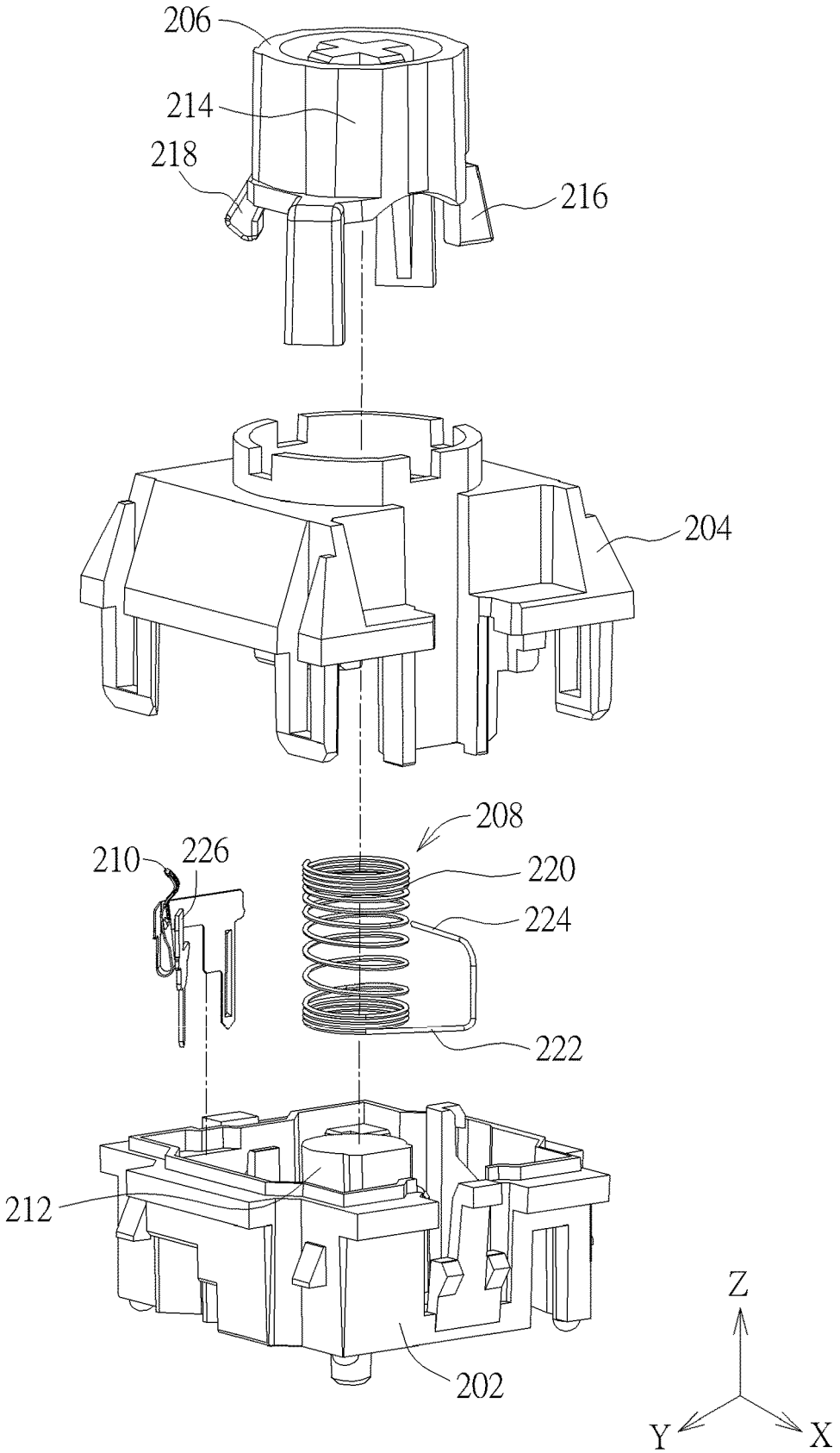
FIG. 15 is an exploded diagram of the button switch in FIG. 14.
Figure 16:
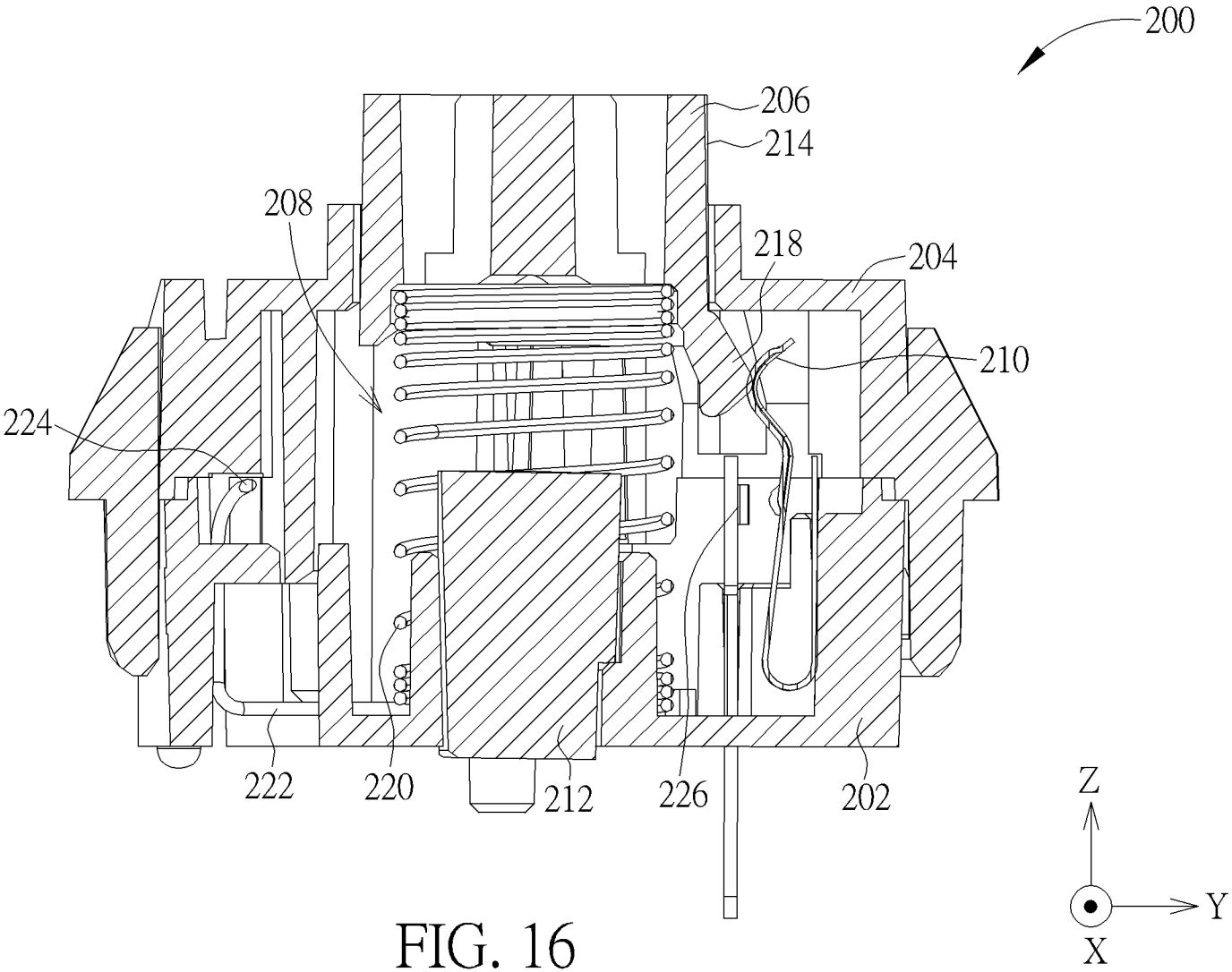
FIG. 16 is a cross-sectional diagram of the button switch in FIG. 14 along a cross-sectional line C-C.
Figure 17:
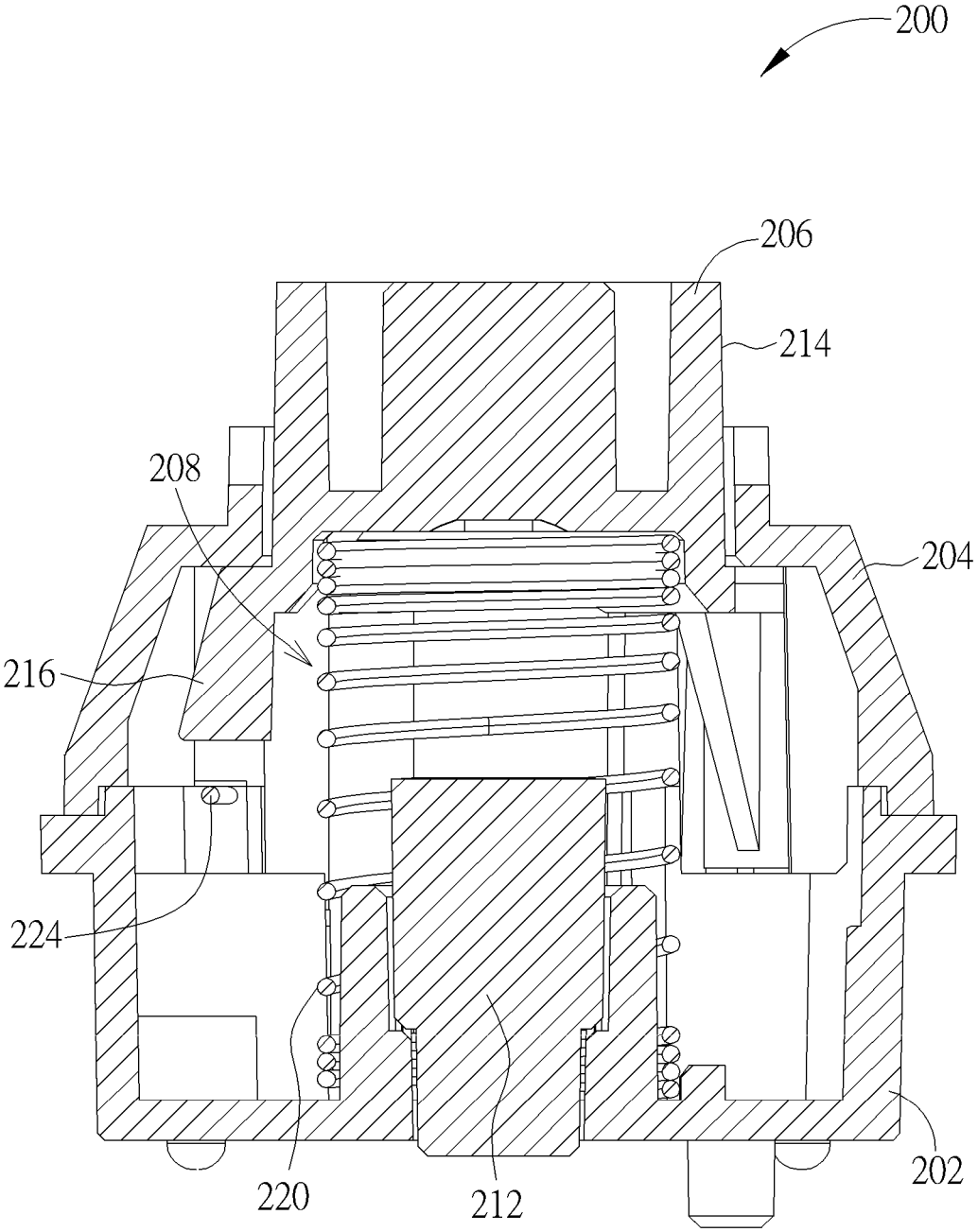
FIG. 17 is a cross-sectional diagram of the button switch in FIG. 14 along a cross-sectional line D-D.

To be noted, the present invention could omit the cap to provide a button switch having the aforesaid feedbacks. For example, please refer to FIG. 14, FIG. 15, FIG. 16, and FIG. 17. FIG. 14 is a diagram of a button switch 200 according to another embodiment of the present invention. FIG. 15 is an exploded diagram of the button switch 200 in FIG. 14. FIG. 16 is a cross-sectional diagram of the button switch 200 in FIG. 14 along a cross-sectional line C-C. FIG. 17 is a cross-sectional diagram of the button switch 200 in FIG. 14 along a cross-sectional line D-D. Components both mentioned in this embodiment and the aforesaid embodiments represent components with similar structures or functions.

To be brief, as shown in FIGS. 14-17, the button switch 200 includes a base 202, a cover 204, a sleeve 206, an elastic member 208, and an arm 210. The arm 210 is adjacent to a pillar 212 of the base 202. The cover 204 is disposed on the base 202. The sleeve 206 jackets the pillar 212 to be movable upward and downward between a high position and a low position. The sleeve 206 has an outer annular surface 214. The outer annular surface 214 has a first rib 216 and a second rib 218. The elastic member 208 has an upward-force-applying portion 220, an extending-rod portion 222, and a flexible-rod portion 224. The extending-rod portion 222 extends from the upward-force-applying portion 220 outwardly to be connected to the flexible-rod portion 224. The flexible-rod portion 224 is located under the first rib 216 (as shown in FIG. 17). Furthermore, the button switch 200 could further include a contact point 226. The arm 210 and the contact point 226 are opposite to each other and extend toward the cover 204 (but not limited thereto, meaning that the present invention could also adopt the aforesaid design in which the arm 22 and the contact point 38 extend along the plane defined by the X-axis and the Y-axis).

Via the aforesaid designs, when the sleeve 206 is located at the high position as shown in FIG. 16, the second rib 218 biases the arm 210 to deform for making the arm 210 separate from the contact point 226. When the sleeve 206 is pressed by an external force, the arm 210 moves to be misaligned with the second rib 218 such that the arm 210 can trigger the contact point 226 for performing a corresponding input function. On the other hand, when the external force is released, the upward-force-applying member 220 drives the sleeve 206 to move upward such that the sleeve 206 can move back to its original position automatically for a user to press.

Furthermore, when the sleeve 206 is located at the high position as shown in FIG. 17, the flexible-rod portion 224 can cross the first rib 216 with downward movement of the sleeve 206 and then collide with the cover to make sound. In such a manner, the button switch 200 can provide a clicky tactile feedback with a click sound. As for the related description for other derived embodiments (e.g. the embodiment in which the flexible-rod portion crosses the rib of the sleeve along the limiting rail to only provide a clicky tactile feedback), it could be reasoned by analogy according to the aforesaid embodiments and omitted herein.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A button switch comprising:

a base having a pillar extending along a Z-axis, the Z-axis, an X-axis and a Y-axis being perpendicular to each other;

a cover disposed on the base;

a sleeve jacketing the pillar to be movable upward and downward between a high position and a low position along the Z-axis, the sleeve passing through the cover and having an outer annular surface, the outer annular surface having a first rib and a second rib;

an elastic member having an upward-force-applying portion, an extending-rod portion, and a flexible-rod portion, the upward-force-applying portion jacketing the pillar and abutting against the sleeve and the base to drive the sleeve to move away from the base, the extending-rod portion extending from the upward-force-applying portion outwardly to be connected to the flexible-rod portion, the flexible-rod portion being located under the first rib; and an arm adjacent to the pillar, the second rib biasing the arm to deform when the sleeve is located at the high position, the second rib being misaligned with the arm when the sleeve is located at the low position;

wherein when the sleeve receives an external force to move downward along the Z-axis, the flexible-rod portion needs to cross the first rib and the arm moves to be misaligned with the second rib with downward movement of the sleeve;

when the sleeve moves downward along the Z-axis and deformation of the flexible-rod portion caused by pressing of the first rib is not enough to make the flexible-rod portion cross the first rib, the flexible-rod portion deforms downward with the first rib;

when deformation of the flexible-rod portion caused by pressing of the first rib is enough to make the flexible-rod portion cross the first rib, the flexible-rod portion is released and then moves upward to collide with the cover to make sound;

when the external force is released, the upward-force-applying portion drives the sleeve to moves upward along the Z-axis relative to the pillar for moving the arm back to be biased by the second rib.

2. The button switch of claim 1 further comprising:

a contact point opposite to the arm; and a circuit board electrically connected to the arm and the contact point respectively;

wherein when the sleeve is located at the high position, the second rib biases the arm to deform for making the arm separate from the contact point;

when the sleeve is located at the low position, the arm moves to be misaligned with the second rib and deformation of the arm is reduced to make the arm abut against the contact point.

3. The button switch of claim 2, wherein the arm and the contact point are disposed substantially along a plane defined by the X-axis and the Y-axis, and when the second rib biases the arm, the arm deforms substantially along the plane defined by the X-axis and the Y-axis.

4. The button switch of claim 2 further comprising:

a bottom board disposed under the circuit board, the base passing through the circuit board to be disposed on the bottom board.

5. A button switch comprising:

a base having a pillar extending along a Z-axis, the Z-axis, an X-axis and a Y-axis being perpendicular to each other;

a cover disposed on the base;

a sleeve jacketing the pillar to be movable upward and downward between a high position and a low position along the Z-axis, the sleeve passing through the cover and having an outer annular surface, the outer annular surface having a first rib and a second rib;

an elastic member having an upward-force-applying portion, an extending-rod portion, and a flexible-rod portion, the cover having a first inclined-surface structure corresponding to the flexible-rod portion, the base having a second inclined-surface structure corresponding to the flexible-rod portion, the first inclined-surface structure and the second inclined-surface structure being spaced from each other for forming a limiting rail, the upward-force-applying portion jacketing the pillar and abutting against the sleeve and the base to drive the sleeve to move away from the base, the extending-rod portion extending from the upward-force-applying portion outwardly to be connected to the flexible-rod portion, the flexible-rod portion being located under the first rib and movably inserted into the limiting rail; and an arm adjacent to the pillar, the second rib biasing the arm to deform when the sleeve is located at the high position, the second rib being misaligned with the arm when the sleeve is located at the low position;

wherein when the sleeve receives an external force to move downward along the Z-axis, the flexible-rod portion needs to cross the first rib and the arm moves to be misaligned with the second rib with downward movement of the sleeve;

when the sleeve moves downward along the Z-axis and deformation of the flexible-rod portion caused by pressing of the first rib is not enough to make the flexible-rod portion cross the first rib, the flexible-rod portion deforms downward with the first rib and moves outwardly along the limiting rail relative to the sleeve;

when deformation of the flexible-rod portion caused by pressing of the first rib is enough to make the flexible-rod portion cross the first rib, the flexible-rod portion moves inwardly along the limiting rail relative to the sleeve;

when the external force is released, the upward-force-applying portion drives the sleeve to moves upward along the Z-axis relative to the pillar for moving the arm back to be biased by the second rib.

6. The button switch of claim 5 further comprising:

a contact point opposite to the arm; and a circuit board electrically connected to the arm and the contact point respectively;

wherein when the sleeve is located at the high position, the second rib biases the arm to deform for making the arm separate from the contact point;

when the sleeve is located at the low position, the arm moves to be misaligned with the second rib and deformation of the arm is reduced to make the arm abut against the contact point.

7. The button switch of claim 6, wherein the arm and the contact point are disposed substantially along a plane defined by the X-axis and the Y-axis, and when the second rib biases the arm, the arm deforms substantially along the plane defined by the X-axis and the Y-axis.

8. The button switch of claim 6 further comprising:

a bottom board disposed under the circuit board, the base passing through the circuit board to be disposed on the bottom board.

9. A button switch comprising:

a base having a pillar extending along a Z-axis, the Z-axis, an X-axis and a Y-axis being perpendicular to each other;

a cover disposed on the base;

a sleeve jacketing the pillar to be movable upward and downward between a high position and a low position along the Z-axis, the sleeve passing through the cover and having an outer annular surface, the outer annular surface having a first rib and a second rib;

an elastic member jacketing the pillar and abutting against the sleeve and the base to drive the sleeve to move away from the base;

an arm adjacent to the pillar, the second rib biasing the arm to deform when the sleeve is located at the high position, the second rib being misaligned with the arm when the sleeve is located at the low position;

a contact point opposite to the arm, the arm and the contact point being disposed substantially along a plane defined by the X-axis and the Y-axis; and a circuit board electrically connected to the arm and the contact point respectively;

wherein when the sleeve is located at the high position, the second rib biases the arm to deform for making the arm separate from the contact point;

when the sleeve receives an external force to move downward to the low position along the Z-axis, the arm moves to be misaligned with the second rib with downward movement of the sleeve and deformation of the arm is reduced to make the arm abut against the contact point;

when the external force is released, the elastic member drives the sleeve to moves upward along the Z-axis relative to the pillar for moving the arm back to be biased by the second rib.

10. The button switch of claim 9 further comprising:

a bottom board disposed under the circuit board, the base passing through the circuit board to be disposed on the bottom board.

11. A keyswitch comprising:

a cap;

a base having a pillar extending along a Z-axis, the Z-axis, an X-axis and a Y-axis being perpendicular to each other;

a cover disposed on the base;

a sleeve jacketing the pillar and passing through the cover to be connected to the cap for making the cap movable upward and downward between a high position and a low position along the Z-axis, the sleeve having an outer annular surface, the outer annular surface having a first rib and a second rib;

an elastic member having an upward-force-applying portion, an extending-rod portion, and a flexible-rod portion, the upward-force-applying portion jacketing the pillar and abutting against the sleeve and the base to drive the sleeve to move away from the base, the extending-rod portion extending from the upward-force-applying portion outwardly to be connected to the flexible-rod portion, the flexible-rod portion being located under the first rib; and an arm adjacent to the pillar, the second rib biasing the arm to deform when the cap is located at the high position, the second rib being misaligned with the arm when the cap is located at the low position;

wherein when the cap receives an external force to drive the sleeve to move downward along the Z-axis, the flexible-rod portion needs to cross the first rib and the arm moves to be misaligned with the second rib with downward movement of the sleeve;

when the sleeve moves downward along the Z-axis and deformation of the flexible-rod portion caused by pressing of the first rib is not enough to make the flexible-rod portion cross the first rib, the flexible-rod portion deforms downward with the first rib;

when deformation of the flexible-rod portion caused by pressing of the first rib is enough to make the flexible-rod portion cross the first rib, the flexible-rod portion is released and then moves upward to collide with the cover to make sound;

when the external force is released, the upward-force-applying portion drives the sleeve to moves upward along the Z-axis relative to the pillar for moving the arm back to be biased by the second rib.

12. The keyswitch of claim 11 further comprising:

a contact point opposite to the arm; and a circuit board electrically connected to the arm and the contact point respectively;

wherein when the cap is located at the high position, the second rib biases the arm to deform for making the arm separate from the contact point;

when the cap is located at the low position, the arm moves to be misaligned with the second rib and deformation of the arm is reduced to make the arm abut against the contact point.

13. The keyswitch of claim 12, wherein the arm and the contact point are disposed substantially along a plane defined by the X-axis and the Y-axis, and when the second rib biases the arm, the arm deforms substantially along the plane defined by the X-axis and the Y-axis.

14. The keyswitch of claim 12 further comprising:

a bottom board disposed under the circuit board, the base passing through the circuit board to be disposed on the bottom board.

15. The keyswitch of claim 14 further comprising:

a lifting mechanism connected to the bottom board and the cap, the cap being movable between the high position and the low position relative to the bottom board via the lifting mechanism.

16. The keyswitch of claim 15, wherein the lifting mechanism comprises a first support member and a second support member, a first support member is movably connected to the bottom board and the cap, a second support member is movably connected to the bottom board and the cap, and the first support member and the second support member pivotably intersect with each other to make the cap movable between the high position and the low position relative to the bottom board.

17. A keyswitch comprising:

a cap;

a base having a pillar extending along a Z-axis, the Z-axis, an X-axis and a Y-axis being perpendicular to each other;

a cover disposed on the base;

a sleeve jacketing the pillar and passing through the cover to be connected to the cap for making the cap movable upward and downward between a high position and a low position along the Z-axis, the sleeve having an outer annular surface, the outer annular surface having a first rib and a second rib;

an elastic member having an upward-force-applying portion, an extending-rod portion, and a flexible-rod portion, the cover having a first inclined-surface structure corresponding to the flexible-rod portion, the base having a second inclined-surface structure corresponding to the flexible-rod portion, the first inclined-surface structure and the second inclined-surface structure being spaced from each other for forming a limiting rail, the upward-force-applying portion jacketing the pillar and abutting against the sleeve and the base to drive the sleeve to move away from the base, the extending-rod portion extending from the upward-force-applying portion outwardly to be connected to the flexible-rod portion, the flexible-rod portion being located under the first rib and movably inserted into the limiting rail; and an arm adjacent to the pillar, the second rib biasing the arm to deform when the sleeve is located at the high position, the second rib being misaligned with the arm when the sleeve is located at the low position;

wherein when the cap receives an external force to drive the cap to move downward along the Z-axis, the flexible-rod portion needs to cross the first rib and the arm moves to be misaligned with the second rib with downward movement of the sleeve;

when the sleeve moves downward along the Z-axis and deformation of the flexible-rod portion caused by pressing of the first rib is not enough to make the flexible-rod portion cross the first rib, the flexible-rod portion deforms downward with the first rib and moves outwardly along the limiting rail relative to the sleeve;

when deformation of the flexible-rod portion caused by pressing of the first rib is enough to make the flexible-rod portion cross the first rib, the flexible-rod portion moves inwardly along the limiting rail relative to the sleeve;

when the external force is released, the upward-force-applying portion drives the sleeve to moves upward along the Z-axis relative to the pillar for moving the arm back to be biased by the second rib.

18. The keyswitch of claim 17 further comprising:

a contact point opposite to the arm; and a circuit board electrically connected to the arm and the contact point respectively;

wherein when the cap is located at the high position, the second rib biases the arm to deform for making the arm separate from the contact point;

when the cap is located at the low position, the arm moves to be misaligned with the second rib and deformation of the arm is reduced to make the arm abut against the contact point.

19. The keyswitch of claim 18, wherein the arm and the contact point are disposed substantially along a plane defined by the X-axis and the Y-axis, and when the second rib biases the arm, the arm deforms substantially along the plane defined by the X-axis and the Y-axis.

20. The keyswitch of claim 18 further comprising:

a bottom board disposed under the circuit board, the base passing through the circuit board to be disposed on the bottom board.

21. The keyswitch of claim 20 further comprising:

a lifting mechanism connected to the bottom board and the cap, the cap being movable between the high position and the low position relative to the bottom board via the lifting mechanism.

22. The keyswitch of claim 21, wherein the lifting mechanism comprises a first support member and a second support member, a first support member is movably connected to the bottom board and the cap, a second support member is movably connected to the bottom board and the cap, and the first support member and the second support member pivotably intersect with each other to make the cap movable between the high position and the low position relative to the bottom board.

23. A keyswitch comprising:

a cap;

a base having a pillar extending along a Z-axis, the Z-axis, an X-axis and a Y-axis being perpendicular to each other;

a cover disposed on the base;

a sleeve jacketing the pillar and passing through the cover to be connected to the cap for making the cap movable upward and downward between a high position and a low position along the Z-axis, the sleeve having an outer annular surface, the outer annular surface having a first rib and a second rib;

an elastic member jacketing the pillar and abutting against the sleeve and the base to drive the sleeve to move away from the base;

an arm adjacent to the pillar, the second rib biasing the arm to deform when the sleeve is located at the high position, the second rib being misaligned with the arm when the sleeve is located at the low position;

a contact point opposite to the arm, the arm and the contact point being disposed substantially along a plane defined by the X-axis and the Y-axis; and a circuit board electrically connected to the arm and the contact point respectively;

wherein when the cap is located at the high position, the second rib biases the arm to deform for making the arm separate from the contact point;

when the cap receives an external force to move downward to the low position along the Z-axis, the arm moves to be misaligned with the second rib with downward movement of the sleeve and deformation of the arm is reduced to make the arm abut against the contact point;

when the external force is released, the elastic member drives the sleeve to moves upward along the Z-axis relative to the pillar for moving the arm back to be biased by the second rib.

24. The keyswitch of claim 23 further comprising:

a bottom board disposed under the circuit board, the base passing through the circuit board to be disposed on the bottom board.

25. The keyswitch of claim 24 further comprising:

a lifting mechanism connected to the bottom board and the cap, the cap being movable between the high position and the low position relative to the bottom board via the lifting mechanism.

26. The keyswitch of claim 25, wherein the lifting mechanism comprises a first support member and a second support member, a first support member is movably connected to the bottom board and the cap, a second support member is movably connected to the bottom board and the cap, and the first support member and the second support member pivotably intersect with each other to make the cap movable between the high position and the low position relative to the bottom board.

* * * * *